US008063794B2

(12) United States Patent
Wang et al.

(10) Patent No.: US 8,063,794 B2
(45) Date of Patent: Nov. 22, 2011

(54) STREET LAMP SYSTEM

(75) Inventors: Chun-Wei Wang, Miao-Li Hsien (TW); Hung-Kuang Hsu, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 293 days.

(21) Appl. No.: 12/233,815

(22) Filed: Sep. 19, 2008

(65) Prior Publication Data

US 2009/0212942 A1 Aug. 27, 2009

(30) Foreign Application Priority Data

Feb. 26, 2008 (CN) ..... 2008 1 0300402

(51) Int. Cl.
*G08G 1/07* (2006.01)

(52) U.S. Cl. ..... 340/917; 340/907; 340/540

(58) Field of Classification Search ..... 340/907, 340/917, 909, 929, 930, 924, 925, 540; 362/800, 362/231

See application file for complete search history.

(56) References Cited

U.S. PATENT DOCUMENTS 7,375,650 B2 * 5/2008 Lo ..... 340/907
2007/0200730 A1 * 8/2007 Kang ..... 340/907

FOREIGN PATENT DOCUMENTS

TW I293744 2/2008

* cited by examiner

*Primary Examiner* — Anh V La
(74) *Attorney, Agent, or Firm* — Altis Law Group, Inc.

(57) ABSTRACT

A street lamp system includes an illumination device, a display unit and a control module. The display unit is configured for displaying oncoming traffic information. The control module is communicatively coupled to the illumination device and the display unit, for sending a first signal to the display unit for displaying the traffic information, and sending a second signal to the illumination device to increase illumination brightness of the illumination device.

1 Claim, 3 Drawing Sheets

STREET LAMP SYSTEM

BACKGROUND

1. Field of the Invention

The present invention generally relates to street lamp systems, and particularly to a street lamp system capable of displaying traffic information.

2. Description of Related Art

A good traffic system provides great convenience to citizens, so a lot of effort goes into the development of traffic system technology.

To ensure traffic safety, transportation information displays are usually applied on roads for displaying traffic information. However, the transportation information displays are only installed at certain road sections, thus traffic information, such as accident information may not be visible at all times.

What is needed, therefore, is an improved street lamp system which can overcome the above shortcomings.

SUMMARY

A street lamp system includes an illumination device, a display unit and a control module. The display unit is configured for displaying oncoming traffic information. The control module is communicatively coupled to the illumination device and the display unit, for sending a first signal to the display unit for displaying the traffic information, and sending a second signal to the illumination device to increase illumination brightness of the illumination device.

Other advantages and novel features of the present street lamp system will become more apparent from the following detailed description when taken in conjunction with the accompanying drawings.

BRIEF DESCRIPTION OF THE DRAWINGS

Many aspects of the present street lamp system can be better understood with reference to the following drawings. The components in the drawings are not necessarily drawn to scale, the emphasis instead being placed upon clearly illustrating the principles of the present street lamp system. Moreover, in the drawings, like reference numerals designate corresponding parts throughout the several views.

DETAILED DESCRIPTION OF EMBODIMENTS

Figure 1:
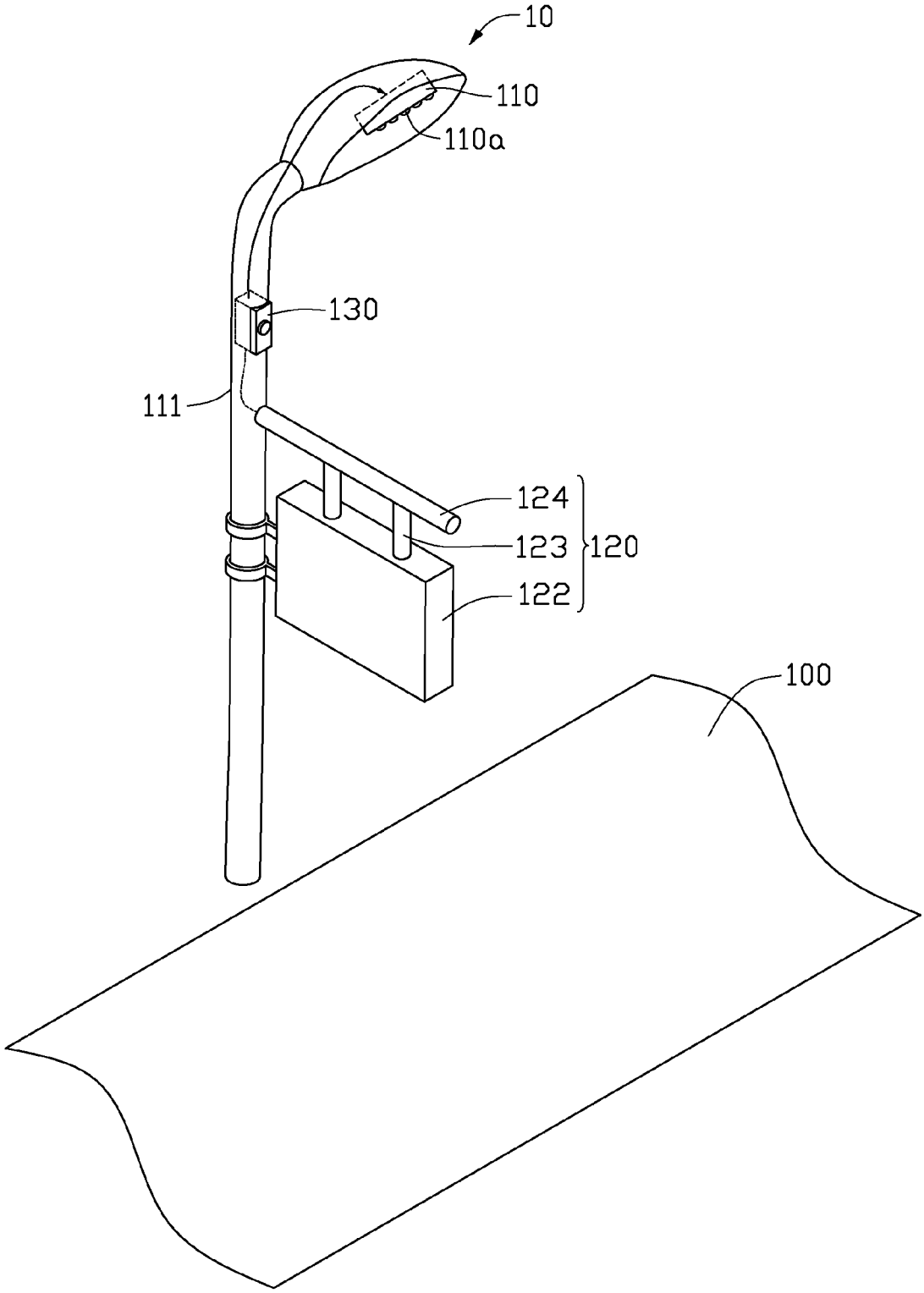
FIG. 1 is a schematic view of a street lamp system, in accordance with a first embodiment of the present invention.

Referring to FIG. 1, a street lamp system 10, in accordance with a first embodiment, is shown. The street lamp system 10 includes an illumination device 110, a display unit 120, and a control module 130.

The street lamp system 10 generally includes a lamp post 111, on which the illumination device 110, the display unit 120 and the control module 130 are installed. The lamp post 111 is positioned on the edge of a traffic lane 100. The illumination device 110 includes a plurality of solid state light sources 110*a*, such as light emitting diodes, to irradiate the traffic lane 100.

The display unit 120 includes a display screen 122 for displaying traffic information. The display screen 122 is formed by a plurality of light emitting diodes arranged in array. Preferably, the light emitting diodes are red light emitting diodes divided into two groups, that is, a first group for displaying characters, and a second group for displaying numbers. The second group and the first group cooperate with each other to display traffic information. The display unit 120 further includes two wires 123 and a circuit interface 124. The circuit interface 124 is electrically connected to the display screen 122 by the wires 123.

The control module 130 is electrically connected to the illumination device 110 and the circuit interface 124, and includes a receiving circuit (not shown) for receiving the traffic information. For example, the traffic information may be an electrical signal sent out by a traffic information center. The receiving circuit is electrically connected to the traffic information center to receive the traffic information. Preferably, the traffic information can be a wireless signal and the receiving circuit is a wireless receiving circuit. The traffic information can be transmitted by wireless communications, such as worldwide interoperability for microwave access (WiMAX), wireless local area network (WLAN), Wi-Fi, blue-tooth or infrared signal transmission.

When the control module 130 receives traffic information, a first signal is generated and sent to the display screen 122 through the circuit interface 124 and the wires 123. The display screen 122 receives the first signal to display traffic information, such as an accident information of "there is an accident N miles ahead", in which a character "N" can be any number displayed by the second group of the light emitting diodes. Furthermore, the character "N" blinks/flashes repeatedly to warn drivers on the road of the accident. At the same time, the control module 130 sent a second signal to the street lamp 110 to increase illumination brightness thereof. For example, part of the light emitting diodes of the street lamp 110 are connected in series to form a first loop, and all the light emitting diodes of the street lamp 110 are connected in series to form a second loop. During the time when there is no second signal being sent, electric current is applied only to the light emitting diodes of the first loop, and the illumination device 110 emits light using the light emitting diodes in the first loop to provide a first illumination brightness. When the second signal is sent out, the same electric current is also applied to the light emitting diodes in the second loop, to provide a second illumination brightness greater than the first illumination brightness.

Figure 2:
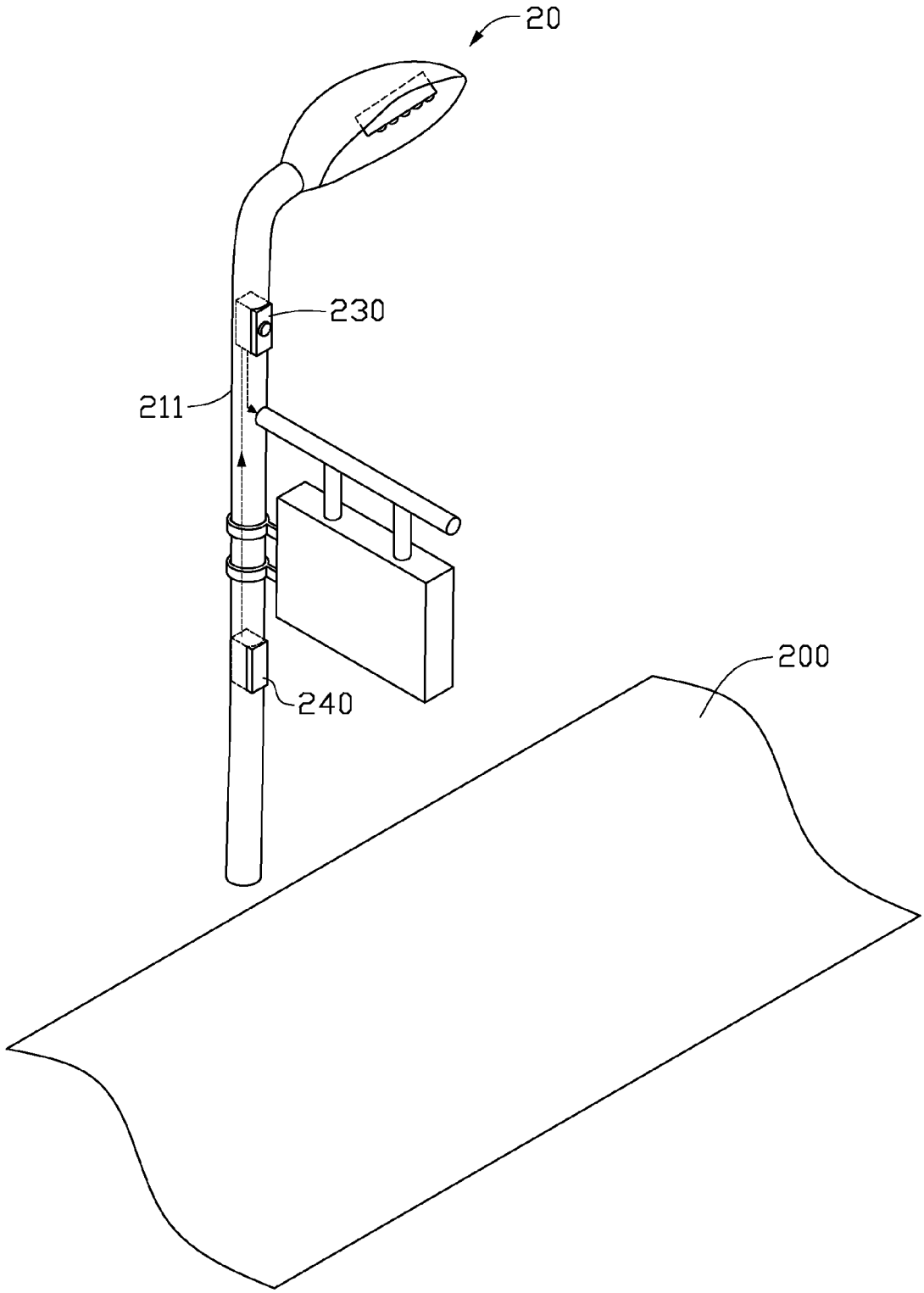
FIG. 2 is a schematic view of a street lamp system, in accordance with a second embodiment of the present invention.

FIG. 2 shows a street lamp system 20, in accordance with a second embodiment. The street lamp system 20 is distinguished from the street lamp system 10 in that a traffic surveillance system 240 is included. The traffic surveillance system 240 is used to help monitoring traffic situation of the traffic lane and obtaining traffic information thereof.

The traffic surveillance system 240 includes a sound recognition device. The sound recognition device is installed on the lamp post 211 and electrically connected to the control module 230, and includes a sound sensor for sensing sounds of the surrounding areas and a memory for pre-storing sounds of motor accidents. The sounds recognized by the sound sensor on the traffic lane 200 are transmitted to the memory, to be compared with the pre-stored accident sounds in the memory, to identify whether there is an accident or not. When the recognized sound is identified as the sound of the accident, the sound recognition device sends a traffic information to the traffic information center. The traffic information is then translated by the traffic information center to the control module 230.

Figure 3:
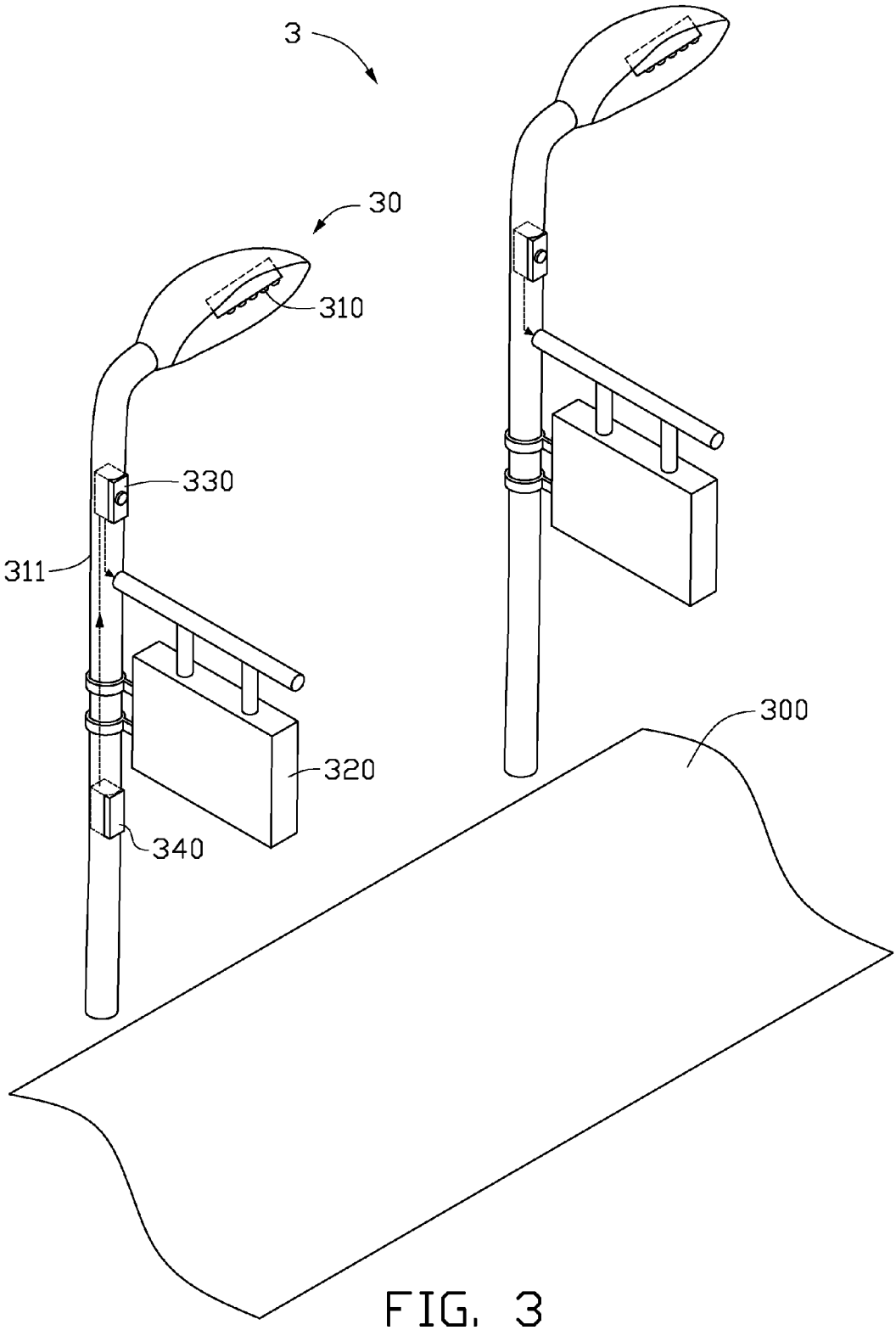
FIG. 3 is a schematic view of a street lamp system, in accordance with a third embodiment of the present invention.

FIG. 3 shows a street lamp system 3, in accordance with a third embodiment. The street lamp system 3 is distinguished from the street lamp system 20 in that a plurality of street lamps 30 are included.

The plurality of street lamps 30 are distributed along a traffic lane 300. Each street lamp 30 includes an illumination device 310, a lamp post 311, a display unit 320, a traffic surveillance system 340. Particularly, the control module 330 is configured for selecting the street lamps 300 according to the traffic situation, and instantly sending the traffic information to the selected street lamps 300. The control module 330 also controls the display units 320 of the selected street lamps 300 to display the traffic information, and controls the illumination devices 310 thereof to provide the second illumination brightness.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary preferred embodiments of the invention.

What is claimed is:

1. A street lamp system, comprising:

a plurality of street lamps distributed along a traffic lane, each street lamp comprising an illumination device for illuminating the traffic lane, the illumination device configured for selectively providing a first illumination brightness or a second illumination brightness greater than the first illumination brightness;

a display unit for displaying oncoming traffic information of the traffic lane;

a traffic surveillance system for monitoring traffic situation of the traffic lane and obtaining traffic information thereof; and a control module communicatively coupled to the street lamps, the control module configured for selecting the street lamps according to the traffic situation and instantly sending the traffic information to the selected street lamps and controlling the display units of the selected street lamps to display the oncoming traffic information, and controlling the illumination devices thereof to provide the second illumination brightness.

* * * * *